US006681962B2

(12) United States Patent
Masuda

(10) Patent No.: US 6,681,962 B2
(45) Date of Patent: Jan. 27, 2004

(54) LIQUID DISPENSING PUMP

(76) Inventor: Masatoshi Masuda, 2, 9-banchi, Takedo-Cho, Saiin, Ukyo-ku, Kyoto-city, Kyoto 615-0031 (JP)

( * ) Notice: Subject to any disclaimer, the term of this patent is extended or adjusted under 35 U.S.C. 154(b) by 73 days.

(21) Appl. No.: 10/020,370

(22) Filed: Dec. 11, 2001

(65) Prior Publication Data

US 2002/0166876 A1 Nov. 14, 2002

(30) Foreign Application Priority Data

May 11, 2001 (JP) ..... 2001-141927

(51) Int. Cl.[7] ..... B67D 5/40
(52) U.S. Cl. ..... 222/321.7; 222/340; 222/383.1
(58) Field of Search ..... 222/321.7, 321.9, 222/340, 383.1

(56) References Cited

U.S. PATENT DOCUMENTS 5,152,434 A 10/1992 Birmelin ..... 222/207
5,803,318 A * 9/1998 Lina ..... 222/321.2
5,813,571 A * 9/1998 Gaucher ..... 222/95
5,819,990 A 10/1998 Cimentepe et al. ..... 222/207
6,021,924 A * 2/2000 Suck et al. ..... 222/105

FOREIGN PATENT DOCUMENTS

KR 20-0241101 7/2001

* cited by examiner

*Primary Examiner*—Joseph A. Kaufman
(74) *Attorney, Agent, or Firm*—Knobbe, Martens, Olson & Bear LLP

(57) ABSTRACT

A liquid dispensing pump, which can effectively prevent coil spring corrosion and elution, is described. This liquid dispensing pump is used for dispensing a liquid stored inside a liquid-storing unit from a nozzle head by pressing down said nozzle head provided over the liquid-storing unit. This liquid dispensing pump possesses a cylinder provided on top of the liquid-storing unit, a piston which can move reciprocally inside the cylinder, a coupling tube for lowering the piston by transmitting pressure applied to the nozzle head by connecting the nozzle head with the piston, a coil spring provided at the peripheral portion of the coupling tube for increasing momentum given to the piston in its ascending direction, an inlet valve for bringing a liquid stored in the liquid-storing unit into the cylinder with the ascending motion of the piston, and an outlet valve mechanism for moving the liquid brought inside the cylinder out to the nozzle head via the coupling tube with the descending motion of the piston.

41 Claims, 12 Drawing Sheets

LIQUID DISPENSING PUMP

BACKGROUND OF THE INVENTION

1. Field of the Invention

The present invention relates to a liquid dispensing pump for dispensing a liquid stored inside a liquid container from a nozzle head by pressing down the nozzle head.

2. Description of the Related Art

Conventional liquid dispensing pumps possess a nozzle head for dispensing a liquid, a liquid container for accumulating and storing the liquid, a cylinder located over the liquid container, an inlet valve for bringing the liquid stored in the liquid container into the cylinder with the ascending motion of the piston and an outlet valve mechanism for bringing the liquid brought into the cylinder out to a nozzle head with the descending motion of the piston.

In these conventional liquid dispensing pumps metal coil springs have been used as a means for increasing momentum to raise the cylinder after releasing the downward pressure applied to the nozzle head to lower the cylinder. These coil springs are normally provided at a position where they can contact a liquid posing a risk of metal spring corrosion. When these liquid dispensing pumps are used in the field of cosmetics, the possibility that a metal constituent may elute into a cosmetic makes such design hygienically undesirable.

Moreover, these liquid dispensing pumps are normally manufactured by molding a resin. When disposing of these liquid dispensing pumps, due to difficulty in dismantling metal coil springs, it becomes impossible to recycle the pumps.

To solve these problems, a resin coil spring may be used. However, the use of the resin coil spring makes it impossible to obtain necessary momentum for making the liquid dispensing pump function properly.

SUMMARY OF THE INVENTION

The present invention describes a liquid dispensing pump, which can effectively prevent a coil spring from corroding and eluting into the liquid while providing a necessary momentum for proper pump function by using a strong metal coil spring.

In an embodiment, the present invention provides a liquid dispensing pump adapted to be connected to a container, comprising: (A) a nozzle head having a nozzle from which a liquid stored in the container is dispensed; (B) an inner tube connected to the nozzle, said tube having (i) a closed end on a side opposite to the nozzle, (ii) a first outward projection at the closed end, (iii) a second outward projection apart from the closed end, and (iv) an opening between the first and second outward projections; (C) a cylinder into which the closed end of the tube is inserted; (D) a piston provided inside the cylinder and movable between the first and second outward projections, said piston being liquid-tightly slidable along an inner wall of the cylinder, wherein (a) when the nozzle head is not pressed downward, the first outward projection liquid-tightly contacts the piston, and (b) when the nozzle head is pressed downward, the first outward projection is detached from the piston to communicate the tube and the cylinder between the first outward projection and the piston through the opening of the tube, whereas the second outward projection pushes the piston downward; (E) a pushing member which constantly pushes the nozzle head upward; and (F) a one-way valve provided at an end of the cylinder opposite to the nozzle head, said valve opening only in a direction to bring a liquid stored in the container into the cylinder; wherein (I) the liquid in the container moves into the cylinder though the valve when the nozzle head moves upward by the pushing member, and (II) the liquid brought in the cylinder moves between the first outward projection and the piston into the tube through the opening of the tube toward the nozzle when the nozzle head is pressed downward.

Any suitable structures and members can be used to constitute the above structures. For example, in an embodiment, the end of the cylinder is tapered, and the valve has a tapered surface to liquid-tightly contact the tapered end of the cylinder when the nozzle head is pressed downward. In another embodiment, the end of the cylinder is tapered, and the valve includes an O-ring to liquid-tightly contact the tapered end of the cylinder when the nozzle head is pressed downward. In still another embodiment, the end of the cylinder has an opening, and the valve includes a ball and a spring pressing the ball downward to liquid-tightly close the opening when the nozzle head is pressed downward, said spring being attached to the closed end of the tube.

Further, in an embodiment, the first outward projection is an O-ring which liquid-tightly contacts the piston when the nozzle head is not pressed. In an embodiment, the second outward projection is an O-ring which liquid-tightly contacts the piston when the nozzle head is pressed.

The liquid dispensing pump may further comprise an upper valve provided at a connection between the nozzle head and the tube, wherein said upper valve opens when the nozzle head is pressed. In the above, in an embodiment, the upper valve includes an O-ring to liquid-tightly close the connection between the nozzle head and the tube when the nozzle head is not pressed downward. In another embodiment, the upper valve includes a ball and a spring pressing the ball upward to liquid-tightly close the connection between the nozzle head and the tube when the nozzle is not pressed downward.

Additionally, the pushing member may be a spring provided along a periphery of the tube.

The present invention can equally be applied to a container with a liquid dispensing pump, which comprises: the liquid dispensing pump described above (with any combination of embodiments); and a container attached to the liquid dispensing pump. Any suitable structures and members can be used to constitute the above structures. For example, the container may be cylindrical.

In the above, in an embodiment, the container has a movable bottom which is liquid-tightly slidable upward along an inner wall of the container according to the pressure in the container, wherein as a liquid is stored in the container and the liquid is dispensed through the nozzle, the movable bottom moves upward. Preferably, the movable bottom is formed in a shape corresponding to the shape of the end of the cylinder of the liquid dispensing pump. The liquid dispensing pump can be liquid-tightly attached to a top of the container.

In another aspect of the present invention, provided is a liquid dispensing pump for dispensing a liquid stored and accumulated inside a liquid-storing unit from a nozzle head by pressing down said nozzle head provided over the liquid-storing unit. The pump comprises: (i) a cylinder provided on top of said liquid-storing unit, (ii) a piston that can move reciprocally inside said cylinder, (iii) a coupling tube for lowering said piston by transmitting pressure applied to said nozzle head by connecting said nozzle head with said piston, (iv) a coil spring provided at the peripheral portion of said coupling tubes for increasing momentum of said piston via said coupling tubes in its ascending direction, (v) an inlet valve for bringing a liquid stored in said liquid-storing unit into said cylinder with the ascending motion of said piston, (vi) and an outlet valve mechanism for moving the liquid brought into said cylinder with the descending motion of said piston out to said nozzle head via inside said coupling tube.

In the above, the inlet valve need not but may be provided near the lower end of said cylinder comprising the first valve mechanism that blocks an opening formed near the lower end of said cylinder, said opening being a passage between said liquid-storing unit and said cylinder, when inside said cylinder is pressurized, and unblocks said opening when inside said cylinder is decompressed. Further, the internal surface of the lower end of said cylinder need not but may be formed in a tapered shape, and said first valve mechanism has a tapered valve body so that its external surface can closely contact the internal surface of the lower end of said cylinder. The first valve mechanism need not but may have a supporting component which can move up and down and an O-ring provided at the periphery of said supporting component. Also, the outlet valve mechanism need not but may comprise the second valve mechanism which opens an opening, said opening being a passage between inside said coupling tube and inside said cylinder, by separating from said piston when said nozzle head is pressed down, and blocks said opening by closely contacting said piston when the pressure applied to said nozzle head is released. In the above, the piston may comprise packings made of resin.

Further, the outlet valve mechanism need not but may be provided near the lower end of said coupling tubes comprising the second valve mechanism that unblocks an opening formed near the lower end of said coupling tubes, said opening being a passage between inside said cylinder and inside said coupling tubes when said nozzle head is pressed down, and blocks said opening when the pressure applied to said nozzle head is released. Alternatively, the outlet valve mechanism may be provided near the upper end of said coupling tubes comprising the second valve mechanism, which unblocks an opening formed near the upper end of said coupling tubes, said opening being a passage between inside said coupling tubes and inside said nozzle head, when said nozzle head is pressed down, and blocks said opening when the pressure applied to said nozzle head is released. In the above, in an embodiment, by being pressed down by said nozzle head from its upper position, the second valve mechanism unblocks the opening formed near the upper end of said coupling tubes, said opening being a passage between inside said coupling tubes and said nozzle head. Further, the second valve mechanism may be provided inside said nozzle head. Additionally, the second valve mechanism may have a supporting component which can move up and down and an O-ring provided at the periphery of said supporting component. Also, in an embodiment, by using the momentum of said coil spring, the second valve mechanism blocks the opening formed near the upper end of said coupling tubes, said opening being the passage between inside said coupling tubes and said nozzle head. In another embodiment, an outlet valve mechanism is provided near the lower end of said coupling tubes comprising the third valve mechanism that unblocks an opening formed near the lower end of said coupling tubes, said opening being a passage between inside said cylinder and inside said coupling tubes when said nozzle head is pressed down, and blocks said opening when the pressure applied to said nozzle head is released. Additionally, the liquid-storing unit may comprise a hard cylinder component and a piston component which moves inside said cylinder component in the direction of said nozzle head as the amount of the liquid decreases.

For purposes of summarizing the invention and the advantages achieved over the prior art, certain objects and advantages of the invention have been described above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention.

In the figures, numbers or symbols used are as follows: 1: Fluid discharge pump; 2: Nozzle head; 3: External lid; 4: Fluid-storing unit; 11: Discharge portion (a nozzle); 12: Pressing portion; 13: Coupling component; 14: Screw component; 15: Cylinder component; 16: Piston component (a movable bottom); 21: Coupling tube (an inner tube); 22: Piston; 23: Cylinder; 24: Coil spring (a pushing member); 25: First valve mechanism (a one-way valve); 26: Second valve mechanism (an upper valve); 27: Third valve mechanism; 41: Opening; 42: Supporting component; 43: O-ring; 44: Opening; 45: Supporting component; 46: O-ring; 47: Opening; 48: O-ring (a first outward projection); 52: Supporting component; 53: O-ring; 61: Second valve mechanism; 63: First valve mechanism; 64: Protruding portion; 65: Valve body; 66: Coil spring; 71: Valve body; 72: Coil spring; 81: First coupling tube (its lower end 100 is a second outward projection); 82: Second coupling tube (81 and 82 are an inner tube); 83: piston; 84: Packing; 85: Packing; 86: First valve mechanism (a one-way valve); 87: Second valve mechanism; 88: Stopper; 89: Valve body; 91: Opening; 92: Convex portion (a first outward projection); 100 Projection (a second outward projection).

DETAILED DESCRIPTION OF THE PREFERRED EMBODIMENT

The present invention will be explained in detail with references to the drawings of the preferred embodiments which are intended to illustrate and not to limit the invention.

Figure 1:
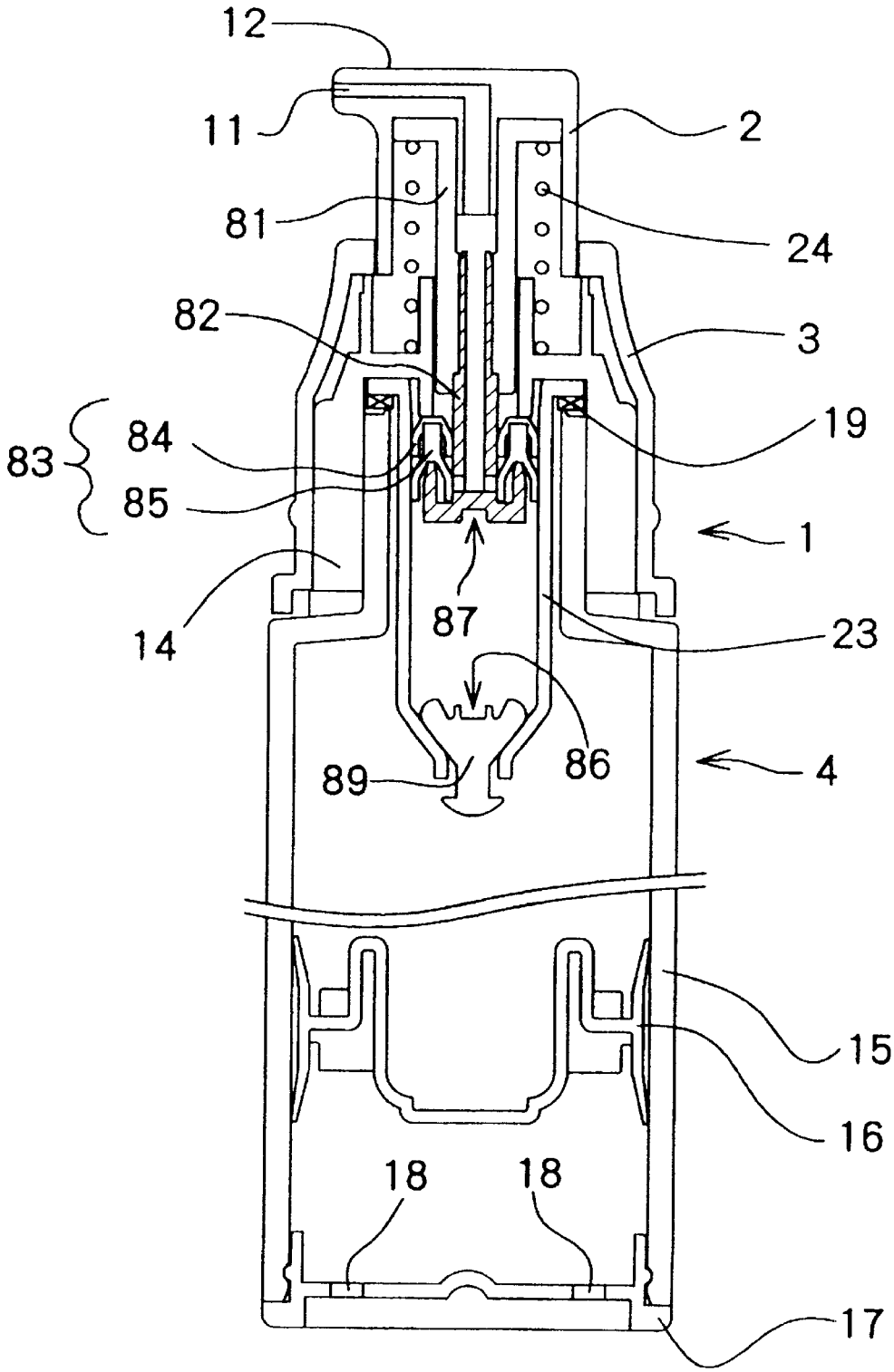
FIG. 1 is a schematic view of a longitudinal section of the liquid container to which the liquid dispensing pump 1 according to the first embodiment of the present invention is attached.
Figure 2:
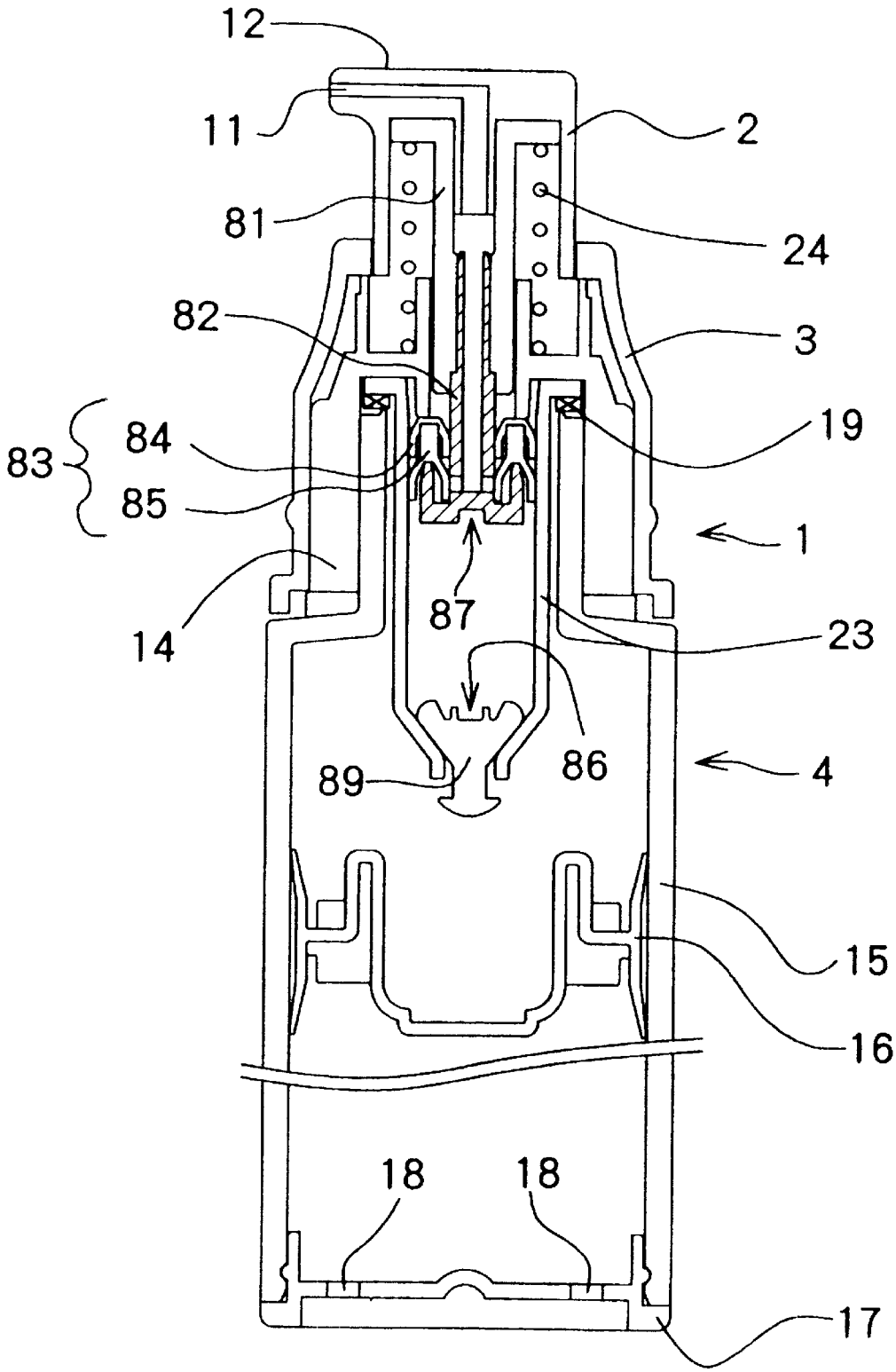
FIG. 2 is a schematic view of a longitudinal section of the liquid container to which the liquid dispensing pump 1 according to the first embodiment of the present invention is attached.

FIG. 1 and FIG. 2 show longitudinal sections of a liquid container to which a liquid dispensing pump 1 according to a first embodiment of the present invention may be attached.

This liquid container may be used as a container for cosmetics for storing gels such as hair styling gels and cleansing gels used in the beauty industry, creams such as nourishing creams and massage creams or liquid such as face lotions. Additionally, in this specification, those including high-viscosity liquids, semi-liquids, gels or creams produced when sol solidifies into jellylike form, and regular liquids are all referred to as "liquid".

This liquid container comprises a liquid dispensing pump 1 according to the present invention, a nozzle head 2, an external lid 3 and a liquid-storing unit 4 for storing the liquid in it.

The nozzle head 2 has a discharge portion 11 for dispensing the liquid and a pressing portion 12 for pressing down when the liquid is dispensed. The external lid 3 is screwed in a screw portion formed at the upper end of the liquid-storing unit 4 via a screw component 14.

The liquid-storing unit 4 may have a cylinder component 15, a piston component 16 which moves up and down inside the cylinder component, and an external lid 17 in which multiple air holes 18 are bored. The cylinder component 15 in the liquid-storing unit 4 and the liquid dispensing pump 1 are connected liquid-tight via packing 19.

In this liquid container, moving the nozzle head up and down by pressing down the pressing portion 12 in the nozzle head 2 causes the liquid stored and accumulated inside the liquid-storing unit 4 to be dispensed from the discharge portion 11 in the nozzle head 2 of the liquid dispensing pump. As the amount of liquid inside the liquid-storing unit 4 decreases, the piston component 16 moves inside the cylinder component 15 in the direction of the nozzle head 2 as shown in FIG. 2.

In this specification, the up and down direction shown in FIG. 1 and FIG. 2 is prescribed as the up and down direction in the liquid container. Namely, in the liquid container according to the present invention, the nozzle head 2 side is assumed as the up direction, and the piston component 16 side is assumed as the down direction.

Figure 3:
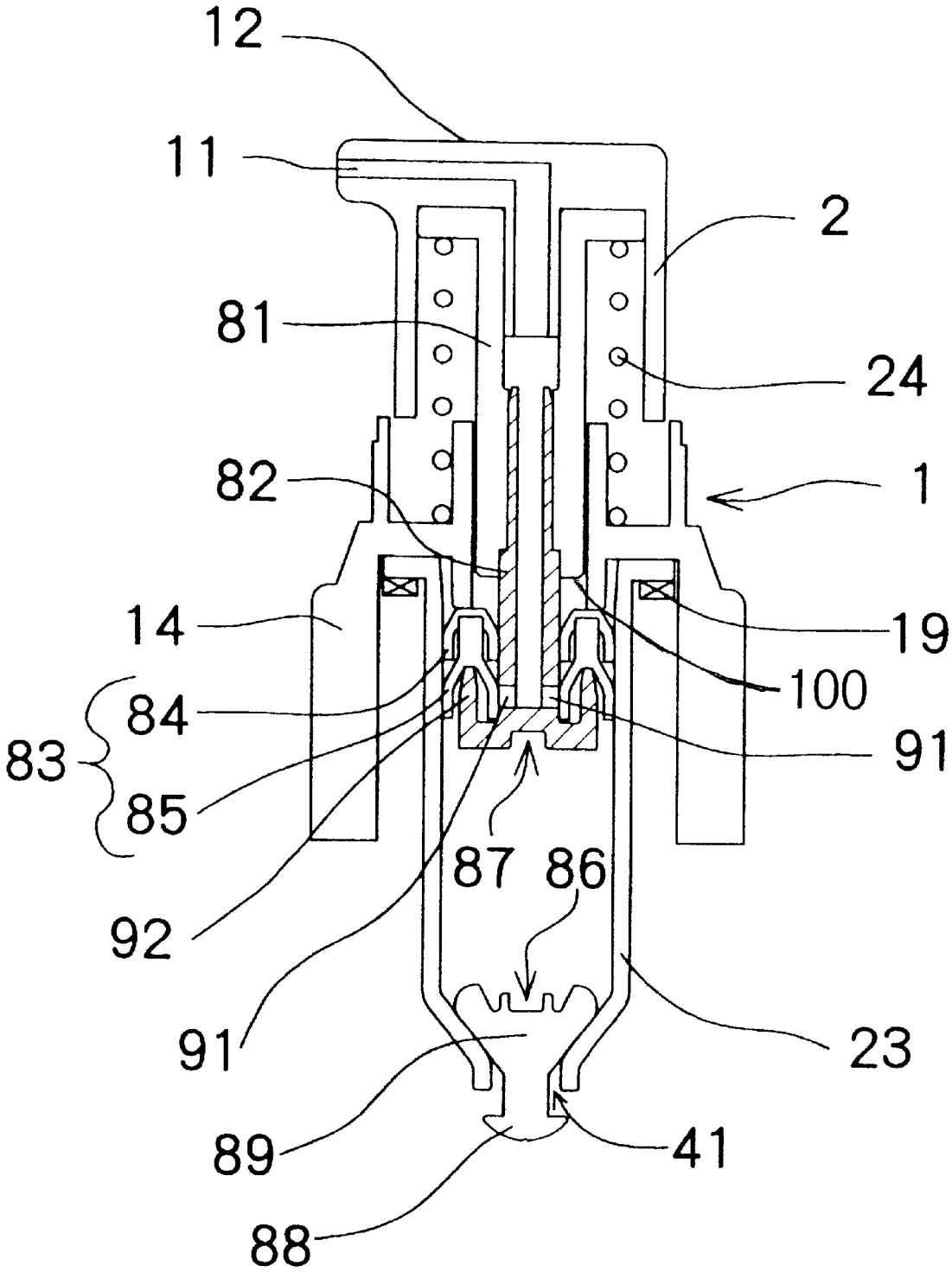
FIG. 3 is a schematic view of a longitudinal section of the liquid dispensing pump 1 according to the first embodiment of the present invention along with the nozzle head 2 in resting position.
Figure 4:
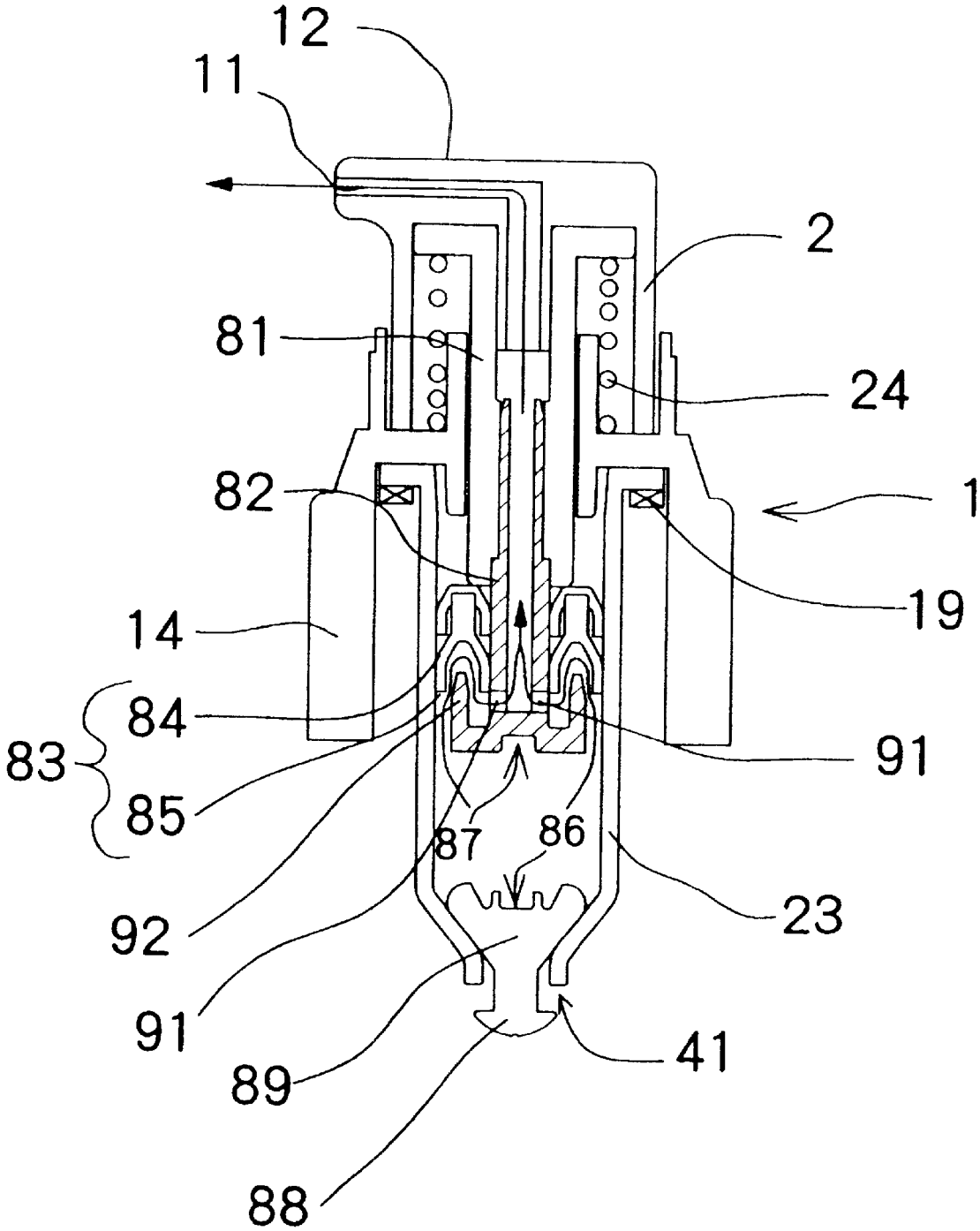
FIG. 4 is a schematic view of a longitudinal section of the liquid dispensing pump 1 according to the first embodiment of the present invention along with the nozzle head 2 under downward pressure applied to said nozzle head 2.
Figure 5:
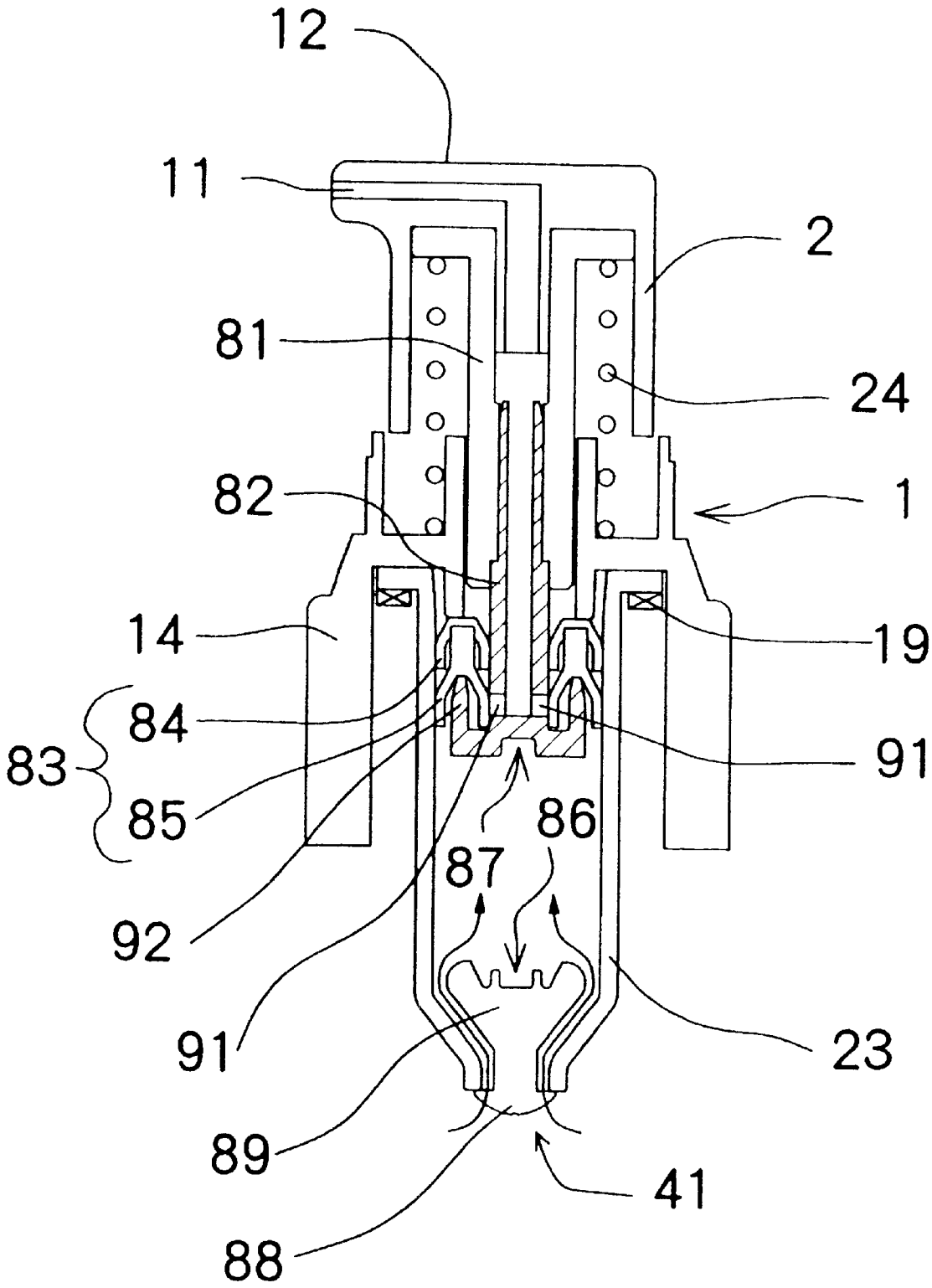
FIG. 5 is a schematic view of a longitudinal section of the liquid dispensing pump 1 according to the first embodiment of the present invention along with the nozzle head 2 after the downward pressure applied to the nozzle head is released.

FIGS. 3 through 5 show longitudinal sections of the liquid dispensing pump 1 of the first embodiment according to the present invention along with the nozzle head 2. FIG. 3 shows a position in which the liquid dispensing pump 1 is presented without stress applied, in resting position. FIG. 4 shows a position in which the coupling tubes 81 and 82 are in the process of descending along with the piston 83 with the pressing portion 12 in the nozzle head 2 being pressed down. FIG. 5 shows a position in which the coupling tubes 81 and 82 are in the process of ascending along with the piston 83 when the pressure applied to the nozzle head 2 is released. In FIGS. 3 through 5, to illustrate the opening 91 clearly, hatching is added only to the coupling tube 82.

In one embodiment, the liquid dispensing pump 1 possesses a cylinder 23, a piston 83 which can move reciprocally inside the cylinder 23, the coupling tubes 81 and 82 which are mutually connected and fixed and comprise a projection 100 for lowering the piston 83 by transmitting pressure applied to the nozzle head 2 via connecting the nozzle head 2 with the piston 83. The liquid dispensing pump further possesses a coil spring 24 provided at the peripheral portion of the coupling tubes 81 and 82 for increasing momentum given to the piston 83 in its ascending direction, an inlet valve comprising the first valve mechanism 86 for bringing a liquid stored in the liquid-storing unit 4 into the cylinder 23 with the ascending motion of the piston 83, and an outlet valve comprising the second valve mechanism 87 for moving the liquid brought inside the cylinder 23 out to the nozzle head 2 through the coupling tubes 81 and 82 with the descending motion of the piston 83.

The piston 83 comprises a pair of packings 84 and 85. These packings 84 and 85 comprise a resin, e.g. silicone rubber.

The first valve mechanism 86 comprising the inlet valve is used for blocking an opening 41 formed near the lower end of the cylinder 23, said opening being a passage between the liquid-storing unit 4 and the cylinder 23, when inside the cylinder 23 is pressurized, and for unblocking the opening 41 when inside the cylinder 23 is decompressed.

This first valve mechanism 86 has a tapered portion which is slanted by the same angle as the internal tapered surface of the lower end of the cylinder 23 and possesses a resin valve body 89 with a stopper 88 provided at the lower end of the valve body. In the first valve mechanism 86, the tapered portion of the valve body 89 blocks the opening 41 by closely contacting the internal tapered surface of the lower end of the cylinder 23 when inside the cylinder 23 is pressurized. When inside the cylinder 23 is decompressed, as shown in FIG. 5, the tapered portion of the valve body 89 unblocks the opening 41 by separating from the internal surface of the lower end of the cylinder 23. At this time, a moving distance of the valve body 89 is controlled by the stopper 88 closely contacting the lower end of the cylinder 23.

A notch, which is not shown in the figures, is formed in the stopper 88. Because of this notch the configuration can be provided, as shown in FIG. 5, in which the liquid can flow in from the opening 41 at the lower end of the cylinder 23 even when the stopper 88 closely contacts the lower end of the cylinder 23.

The second valve mechanism 87 comprising the outlet valve is for opening a passage between inside of the coupling tubes 81 and 82 and inside the cylinder 23 by separating from the piston 83 when the nozzle head 2 is pressed down and for blocking said passage by closely contacting the piston 83 when the pressure to the nozzle head 2 is released.

An opening 91 is provided at the bottom of the coupling tube 82. Outside the opening 91 a convex portion 92 is formed that can contact the concave portion of the packing 85 comprising the piston 83. As shown in FIG. 4, in a position where the packing 85 and the convex portion 92 in the coupling tube 82 are separated, a passage from inside the cylinder 23 to inside the coupling tubes 81 and 82 via the opening 91 is formed. As shown in FIG. 3 and FIG. 5, in a position in which the concave portion of the packing 85 and the convex portion in the coupling tube 82 closely contact each other, the passage from inside the cylinder 23 to inside the coupling tubes 81 and 82 is blocked.

For the coil spring 24, in order to obtain powerful momentum, a metal coil spring is used. Because the coil spring 24 is provided at the peripheral portion of the coupling tube comprising the coupling tubes 81 and 82, it does not contact the liquid passing through said coupling tube.

The liquid dispensing operation of a liquid container possessing the above-mentioned liquid dispensing pump 1 according to the first embodiment of the present invention is described in FIGS. 3 through 5.

In an initial position, as shown in FIG. 3, pressure to the coupling tubes 81 and 82 which are mutually connected is applied upward by the action of the coil spring 24, and the convex portion 92 formed at the lower end of the coupling tube 82 closely contacts the concave portion of the packing 85. Consequently, a passage from inside the cylinder 23 to inside the coupling tubes 81 and 82 is blocked. By the empty weight of the valve body 89, the tapered portion of the valve body 89 closely contacts the internal surface of the lower end of the cylinder 23 blocking the opening 41.

As shown in FIG. 4, when the pressing portion 12 in the nozzle head 2 is pressed down, the coupling tubes 81 and 82 first descend relatively to the piston 83. By this, the convex portion 92 formed at the lower end of the coupling tube 82 separates from the concave portion of the packing 85. Due to this, a passage from inside the cylinder 23 to inside the coupling tubes 81 and 82 via the opening 91 is formed.

When the pressing portion 12 of the nozzle head 2 is further pressed down, the lower end of the second coupling tube 81 and the top of the packing 84 comprising the piston 83 contact. As a result the piston 83 and the coupling tubes 81 and 82 descend as one. At this time, inside the cylinder 23 is pressurized and the opening 41 is blocked by the tapered portion of the valve body 89 closely contacting the internal tapered surface of the lower end of the cylinder 23. Consequently, a pressurized liquid inside the cylinder flows out through the opening 91 and the coupling tubes 81 and 82 and is dispensed from the discharge portion 11.

When the pressure applied to the nozzle head 2 is released after the piston 83 descends to the lower end of a stroke, the coupling tubes 81 and 82 ascend relatively to the piston 83 by the action of the coil spring 24. As a result, as shown in FIG. 5, the convex portion 92 formed at the lower end of the coupling tube 82 closely contacts the concave portion of the packing 85. Consequently, the opening 91 from inside the cylinder 23 to inside the coupling tubes 81 and 82 is blocked again.

After that, by the action of the coil spring 24, the nozzle head 2, the coupling tubes 81 and 82 and the piston 83 ascend as one. At this time, because inside the cylinder 23 is decompressed, the opening 41 is unblocked by separating of the tapered portion of the valve body 89 from the internal tapered surface of the lower end of the cylinder 23, resulting in the liquid flow into the cylinder 23 from the liquid-storing unit 4 via the notch formed in the stopper 88. As shown in FIG. 5, when the piston 83 moves to the upper end of its elevating stroke, it stops its ascending motion.

By repeating the above-mentioned operation, dispensing the liquid stored in the liquid-storing unit 4 from the nozzle head 2 becomes possible.

Figure 6:
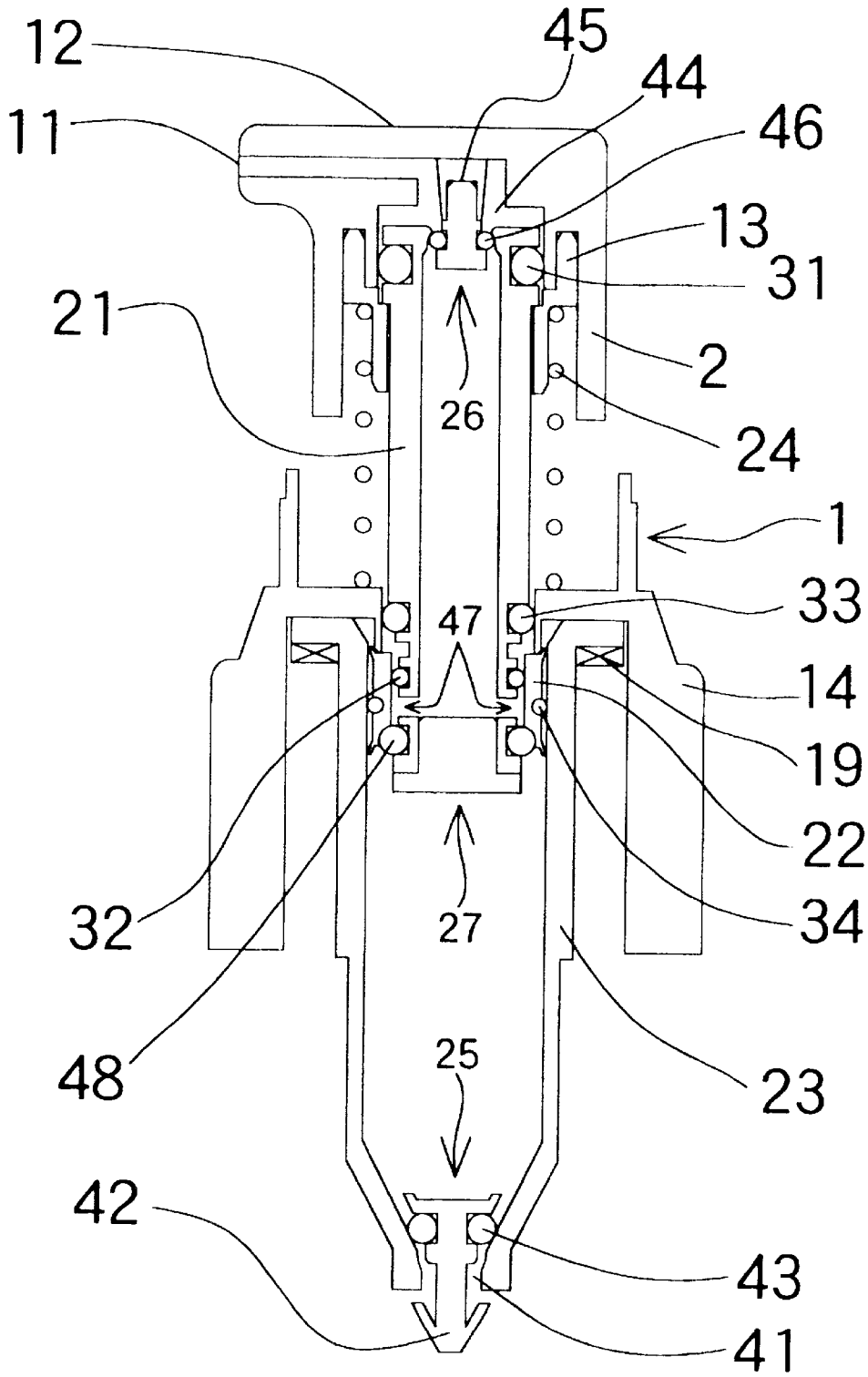
FIG. 6 is a schematic view of a longitudinal section of the liquid dispensing pump 1 according to the second embodiment of the present invention along with the nozzle head 2 in resting position.
Figure 7:
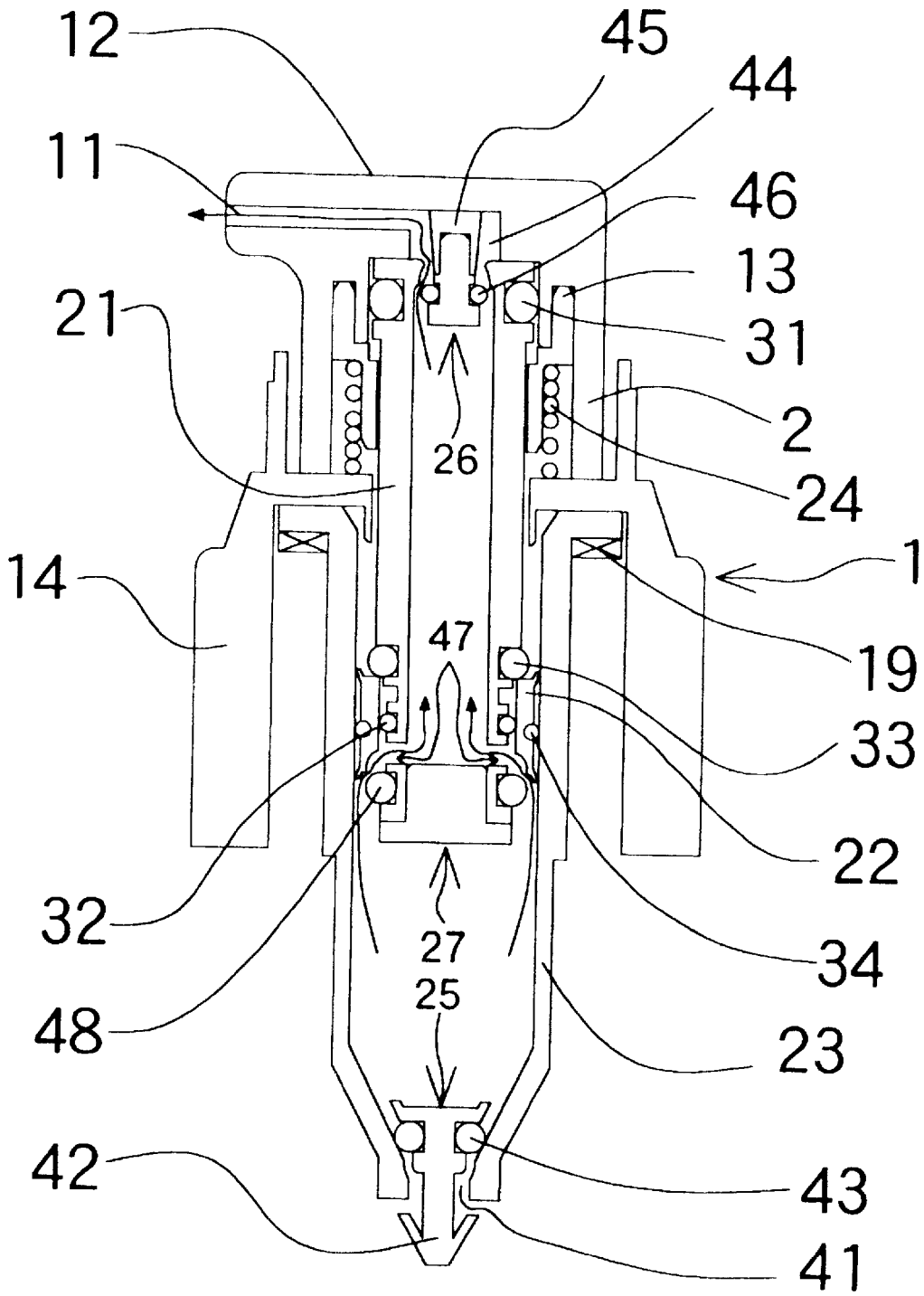
FIG. 7 is a schematic view of a longitudinal section of the liquid dispensing pump 1 according to the second embodiment of the present invention along with the nozzle head 2 under downward pressure applied to said nozzle head 2.
Figure 8:
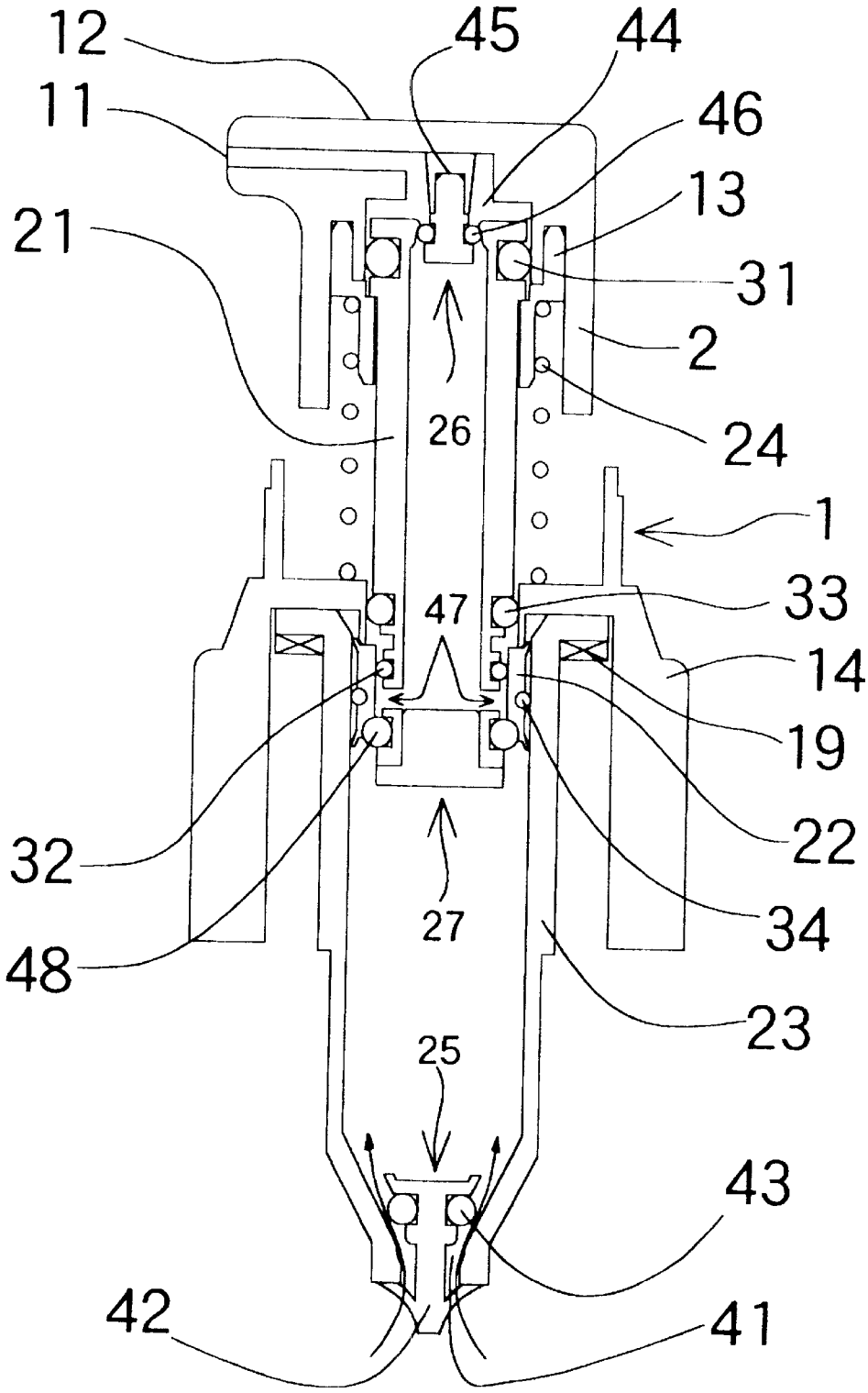
FIG. 8 is a schematic view of a longitudinal section of the liquid dispensing pump 1 according to the second embodiment of the present invention along with the nozzle head 2 after the downward pressure applied to the nozzle head is released.

FIG. 6 through FIG. 8 show longitudinal sections of the liquid dispensing pump 1 of a second embodiment according to the present invention.

FIG. 6 shows the liquid dispensing pump 1 in resting position, without applied pressure. FIG. 7 shows a position in which a coupling tube 21 is in the process of descending along with a piston 22 due to the pressing portion 12 in the nozzle head 2 being pressed down. FIG. 8 shows a position in which the coupling tube 21 is in the process of ascending along with the piston 22 when the pressure to the nozzle head 2 is released.

Similarly to the liquid dispensing pump 1 according to the first embodiment shown in FIG. 1 and FIG. 2, the liquid dispensing pump 1 according to the second embodiment may be attached on top of the liquid-storing unit 4. Detailed descriptions of the same components used in the above-mentioned first embodiment are omitted by assigning the same numbers used in the first embodiment.

The liquid dispensing pump 1 according to the second embodiment possesses a cylinder 23, a piston 22 which can move reciprocally inside the cylinder 23, a coupling tube 21 for lowering the piston 22 by connecting the nozzle head 2 with the piston 22 and transmitting pressure applied to the nozzle head 2 to the piston 22, a coil spring 24 provided at the peripheral portion of the coupling tube 21 for increasing momentum given to the piston 22 in its ascending motion, an inlet valve comprising the first valve mechanism 25 for bringing a liquid stored in the liquid-storing unit 4 into the cylinder 23 with the ascending motion of the piston 23, and an outlet valve mechanism comprising the second and third valve mechanisms 26 and 27 for moving the liquid brought inside the cylinder 23 out to the nozzle head 2 via inside the coupling tube 21 with the descending motion of the piston 22. The nozzle head 2 is connected with the coupling tube 21 via a coupling component 13 and is detachable from the liquid dispensing pump 1.

The nozzle head 2 and the coupling tube 21 are connected in a manner that they can move up and down by a slight distance (e.g., 5–50 mm). Between the inner circumference of the nozzle head 2 and the upper-end periphery of the coupling tube 21, an O-ring 31 is provided for preventing a liquid leak. Similarly, the coupling tube 21 and the piston 22 are connected in a manner that they can move up and down by a slight distance. Between the periphery of the coupling 21 and the inner circumference of the piston 22, an O-ring 32 is provided for preventing a liquid leak.

Above the piston 22 at the periphery of the coupling tube 21, an O-ring 33 is provided, and between the periphery of the piston 22 and the inner circumference of the cylinder 23, an O-ring 34 is provided.

The first valve mechanism 25 comprising the above-mentioned inlet valve is provided for blocking an opening 41 formed near the lower end of the cylinder 23, said opening being a passage between the liquid-storing unit 4 and the cylinder 23, when inside the cylinder 23 is pressurized, and for unblocking the opening 41 when inside the cylinder 23 is decompressed.

The first valve mechanism 25 comprises a resin (any suitable plastic) supporting component 42 possessing an umbrella-shaped portion at its tip and an O-ring 43 provided at the periphery of the rear anchor of the supporting component 42. In this first valve mechanism 25, when inside the cylinder 23 is pressurized, as shown in FIG. 7, the O-ring 43 and the lower-end inner circumference of the cylinder 23 closely contact, blocking the opening 41. When inside the cylinder 23 is decompressed, as shown in FIG. 8, the O-ring 43 separates from the lower-end inner circumference of the cylinder 23, unblocking the opening 41. At this time, a moving distance of the O-ring 43 is controlled by the umbrella-shaped portion of the supporting component 42 closely contacting the lower end of the cylinder 23.

A notch, which is not shown in the figures, is formed in the umbrella-shaped portion of the supporting component 42. Because of this notch the configuration can be provided, as shown in FIG. 8, in which the liquid can flow in from the opening 41 at the lower end of the cylinder 23 even when the umbrella-shaped portion of the supporting component 42 closely contacts the lower end of the cylinder 23.

The second valve mechanism 26 comprising the outlet valve is provided for unblocking an opening 44 formed near the upper end of the coupling tube 21, said opening being a passage between inside the coupling tube 21 and the nozzle head, when the nozzle head 2 is pressed down, and for blocking the opening 44 when the pressure applied to the nozzle head 2 is released.

The second valve mechanism 26 possesses a supporting component 45 attached inside the nozzle head 2 and an O-ring 46 provided at the periphery of the supporting component 45. In this second valve mechanism, when the nozzle head 2 is pressed down, as shown in FIG. 7, the O-ring 46 separates from the upper-end inner circumference of the coupling tube 21 by the movement of the supporting component 45 caused by the pressure, unblocking the opening 44. When the pressure applied to the nozzle head 2 is released, as shown in FIG. 8, the O-ring 46 contacts the upper-end inner circumference of the coupling tube 21 by the movement of the supporting component 45 with the upward momentum of the coil spring 24, blocking up the opening 44.

Figure 9:
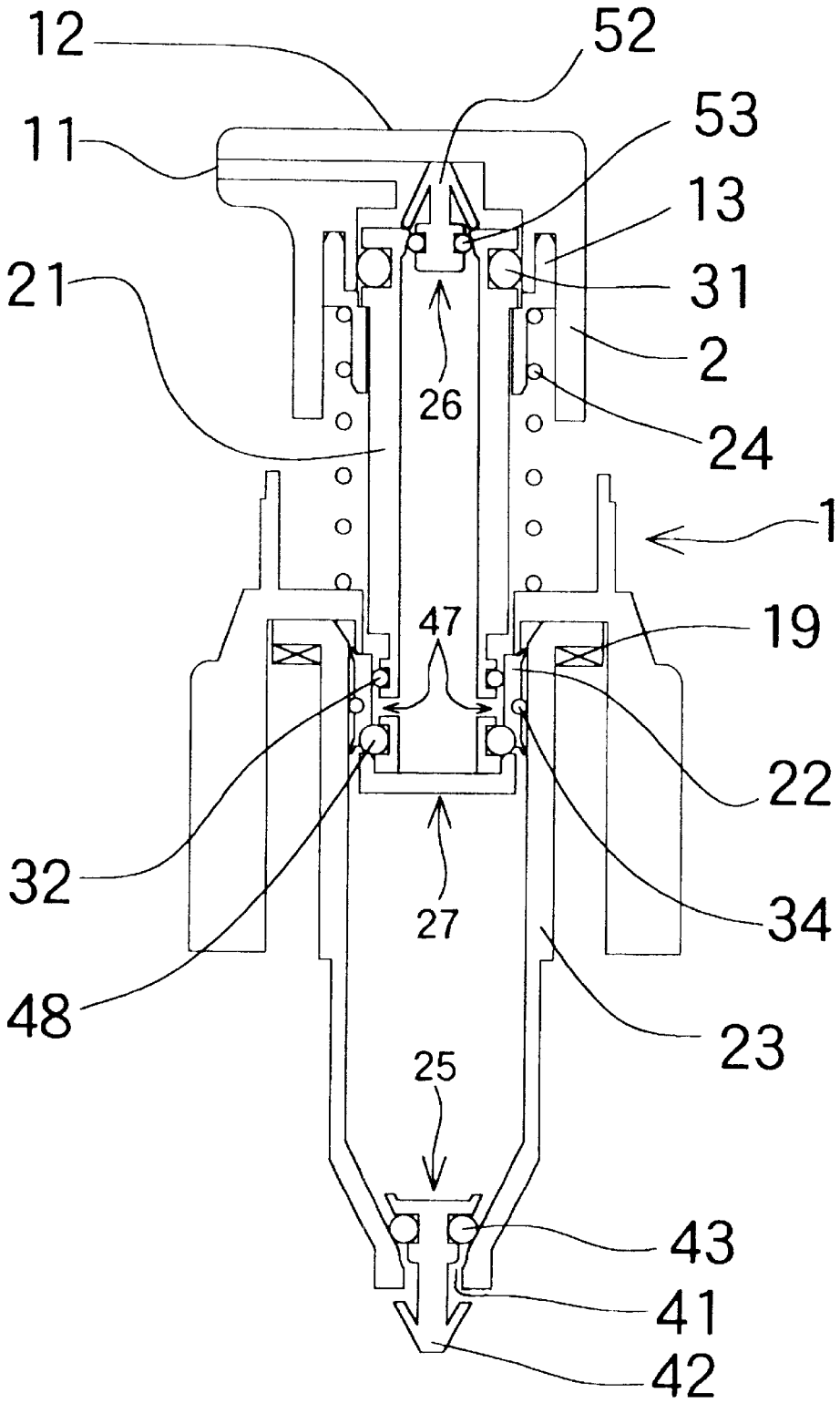
FIG. 9 is a schematic view of a longitudinal section of a modified example of the liquid dispensing pump 1 according to the second embodiment of the present invention along with the nozzle head 2.

Another example of the second valve mechanism 26 as shown in FIG. 9 is similar to the above-mentioned first valve mechanism 25, as it possesses a resin (any suitable plastic) supporting component 52 with an umbrella-shaped portion (resilient) at its tip and an O-ring 53 provided at the periphery of the rear anchor of the supporting component 52. In this case, when the nozzle head 2 is pressed down, the umbrella-shaped portion of the supporting component is pressed down by the nozzle head 2.

Referring to FIG. 6 through FIG. 8 again, the third valve mechanism 27 comprising the above-mentioned outlet valve mechanism is provided for unblocking an opening 47 formed near the lower end of the coupling tube 21, said opening being a passage between inside the cylinder 23 and inside the coupling tube 21, when the nozzle head 2 is pressed down, and for blocking the opening 47 when the pressure applied to the nozzle head 2 is released.

The third valve mechanism 27 possesses an O-ring 48 provided at the lower-end periphery of the coupling tube 21. In this third valve mechanism 27, as shown in FIG. 7, when the nozzle head 2 is pressed down, the coupling tube 21 descends relatively to the piston 22, and the opening 47 is unblocked by the O-ring 48 separating from a valve seat formed at the lower end of the piston 22. When the pressure applied to the nozzle head 2 is released, as shown in FIG. 8, the coupling tube 21 ascends relatively to the piston 22, and the opening 47 is blocked by the O-ring 48 closely contacting the valve seat formed at the lower end of the piston 22.

All of the above-mentioned O-rings 31, 32, 33, 34, 43, 46, 48, and 53 comprise silicone rubber, for example.

For the coil spring 24, in order to obtain powerful momentum, a metal coil spring is used. Because the coil spring 24 is provided at the peripheral portion of the coupling tube 21, it does not contact the liquid passing through the coupling tube 21.

The liquid dispensing operation of a liquid container possessing the liquid dispensing pump 1 according to the second embodiment of the present invention is described in FIGS. 6 through 8.

In an initial position, as shown in FIG. 6, the O-ring 46 forcibly contacts the upper-end inner circumference of the coupling tube 21 by the action of the coil spring 24, and blocks the opening 44. In the same manner, the coupling tube 21 is in an ascending position relatively to the piston 22, and the O-ring 48 closely contacts the valve seat formed at the lower end of the piston 22, blocking the opening 47. The O-ring 43 closely contacts the lower-end inner circumference of the cylinder 23 by the empty weight of the O-ring 43 and the supporting component 42.

In this initial position, because the two openings 44 and 47 are securely blocked by the O-rings 46 and 48, it becomes possible to surely prevent leaking of the liquid from the nozzle head 2, even when high pressure is applied to the liquid stored in the liquid-storing unit 4 (e.g. due to a rise of the temperature of the liquid, etc).

When the pressing portion 12 in the nozzle head 2 is pressed down, as shown in FIG. 7, the nozzle head 2 descends relatively to the coupling tube 21. As a result, the opening 44 is unblocked by the O-ring 46 provided at the periphery of the supporting component 45 by separating from the lower-end inner circumference of the coupling tube 21.

When the pressing portion 12 in the nozzle head 2 is further pressed down, the upper end of the coupling tube 21 and the nozzle head 2 closely contact and descend as one. Due to this, the coupling tube 21 descends relatively to the piston 22, and the O-ring 48 separates from a valve seat formed at the lower end of the piston 21, unblocking the opening 47.

When the pressing portion 12 in the nozzle head 2 is further pressed down, the nozzle head 2, the coupling tube 21 and the piston 22 descend as one with the upper end of the piston 22 closely contacting the O-ring 33 provided at the periphery of the coupling tube 21. At this time inside the cylinder 23 is pressurized, the O-ring 43 closely contacts the lower-end inner circumference of the cylinder 23, and the opening 41 is blocked. Consequently, a pressurized liquid inside the cylinder 23 flows out to the discharge portion 11 in the nozzle head 2 via the coupling tube 21 and the opening 44 and is dispensed from the discharge portion 11.

When the pressure applied to the nozzle head 2 is released after the piston 22 descends to the lower end of a stroke, the nozzle head 2 ascends relatively to the coupling tube 21 by the action of the coil spring 24. At this time, the coupling tube 21 ascends relatively to the piston 22. Due to this, as shown in FIG. 8, the O-ring 46 in the second valve mechanism 26 closely contacts the upper-end inner circumference of the coupling tube 21, blocking the opening 44. In the third valve mechanism 27, the O-ring 48 closely contacts a valve seat formed at the lower end of the piston 22, blocking the opening 47.

After that, by the action of the coil spring 24, the nozzle head 2, the coupling tube 21 and the piston 22 ascend as one. At this time, because inside the cylinder 23 is decompressed, the opening 41 is unblocked by the O-ring 43 separating from the lower-end inner circumference of the cylinder 23, and the liquid flows into the cylinder 23 from the liquid-storing unit 4. As shown in FIG. 8, when the piston 22 moves to the upper end of its elevating stroke, it stops its ascending motion.

By repeating the above-mentioned operation, dispensing the liquid stored in the liquid-storing unit 4 from the nozzle head 2 becomes possible.

Figure 10:
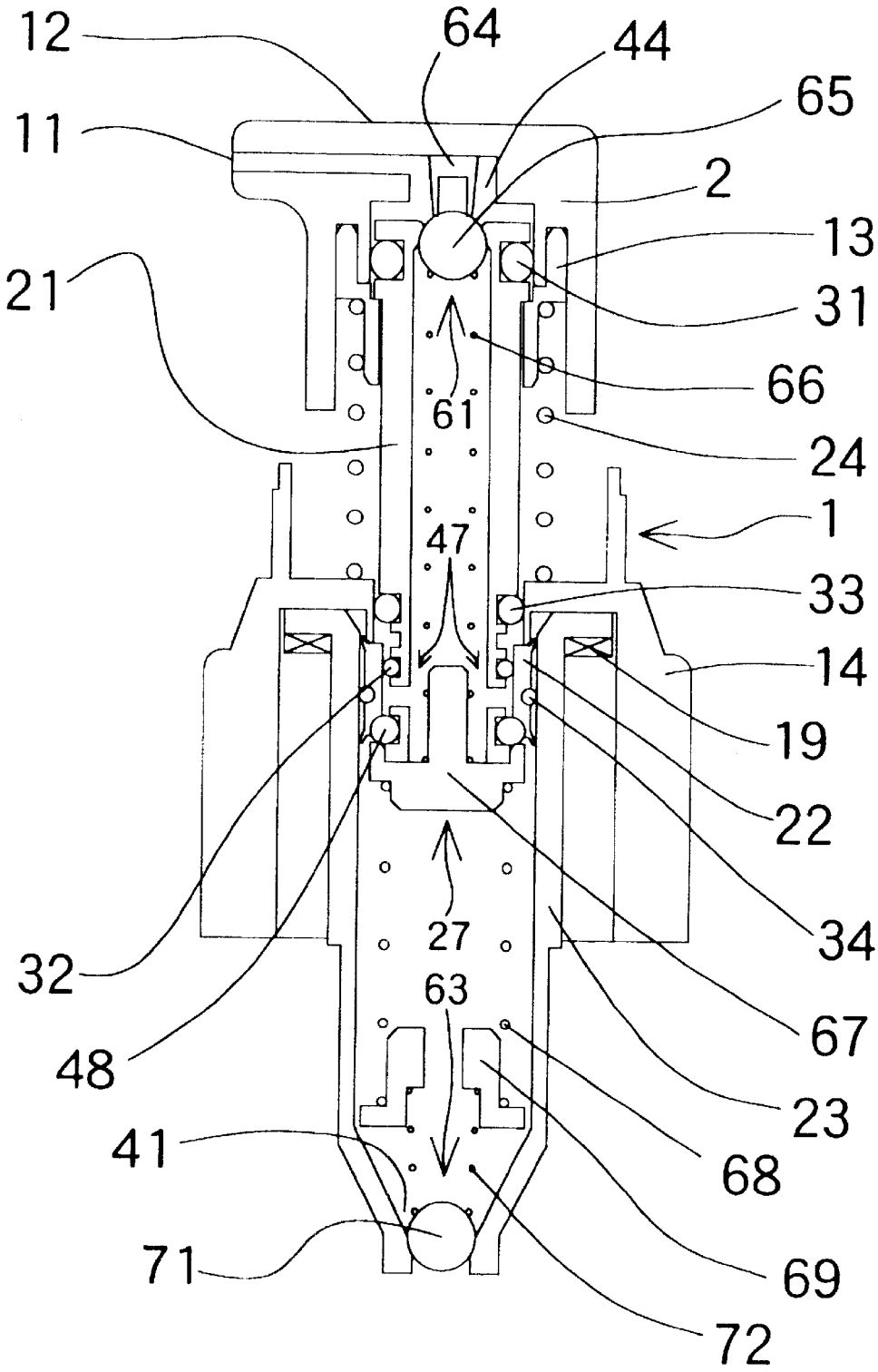
FIG. 10 is a schematic view of a longitudinal section of the liquid dispensing pump 1 according to the third embodiment of the present invention along with the nozzle head 2 in resting position.
Figure 11:
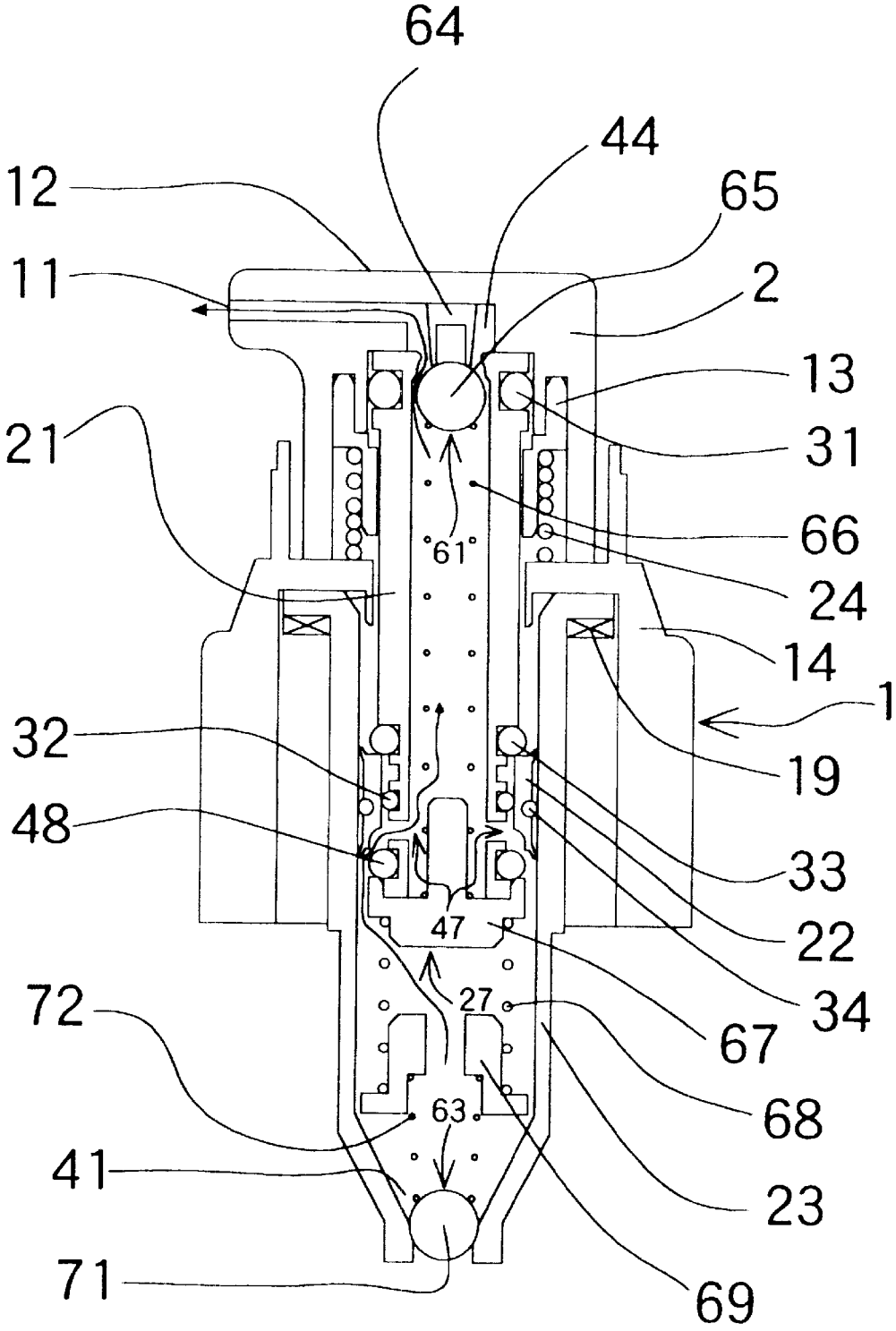
FIG. 11 is a schematic view of a longitudinal section of the liquid dispensing pump 1 according to the third embodiment of the present invention along with the nozzle head 2 under downward pressure applied to said nozzle head 2.
Figure 12:
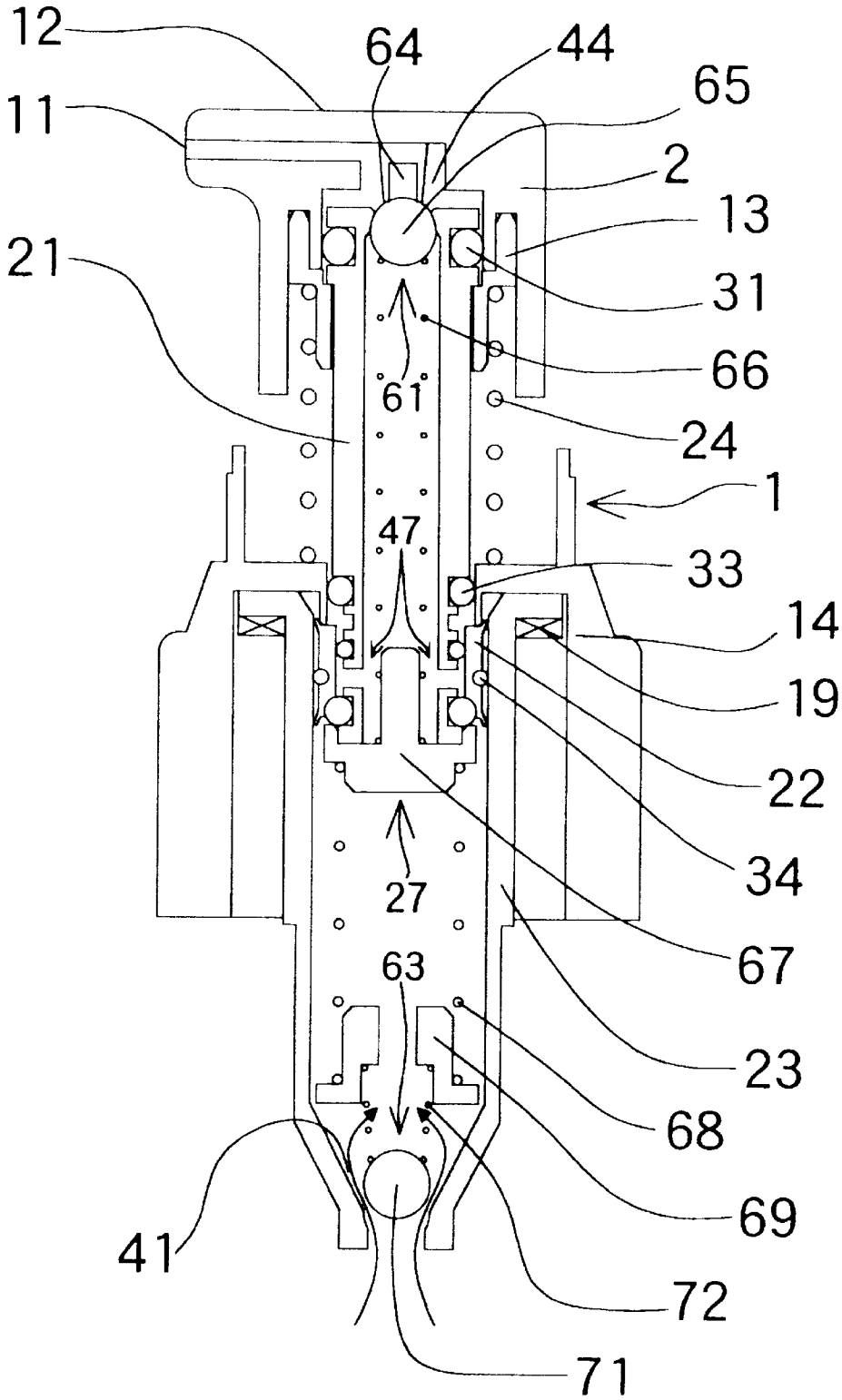
FIG. 12 is a schematic view of a longitudinal section of the liquid dispensing pump 1 according to the third embodiment of the present invention along with the nozzle head 2 after the downward pressure applied to the nozzle head is released.

The third mode for carrying out the present invention is described in FIGS. 10 through 12 that show longitudinal sections of the liquid dispensing pump 1 according to the third embodiment of the present invention along with the nozzle head 2.

FIG. 10 shows the liquid dispensing pump 1 without applied downward pressure. FIG. 11 shows a position in which the coupling tube 21 is in the process of descending along with the piston 22 due to the pressing portion 12 in the nozzle head 2 being pressed down. FIG. 12 shows a position in which the coupling tube 21 is in the process of ascending along with the piston 22 after the downward pressure to the nozzle head 2 is released.

Similarly to the liquid dispensing pump according to the first embodiment shown in FIG. 1 through FIG. 5 and to the liquid dispensing pump according to the second embodiment shown in FIG. 6 through FIG. 9, the liquid dispensing pump 1 according to the third embodiment may be attached on top of the liquid-storing unit 4. Detailed descriptions of the same components used in the above-mentioned first or second embodiments are omitted by assigning the same numbers used in the first and the second embodiments.

The third embodiment of the present invention uses a first valve mechanism 63 utilizing a spherical valve body 71 and a coil spring 72 for increasing downward momentum given to the valve body 71, and a second valve mechanism 61 utilizing a spherical valve body 65 and a coil spring 66 for increasing upward momentum given to the valve body 65.

Namely, the first valve mechanism 63 comprising an inlet valve that possesses the spherical valve body 71 and the coil spring 72 supported by a supporting body 69 for increasing momentum of the spherical valve body 71 toward the lower end of the cylinder 23, which functions as a valve seat for this valve body 71. The supporting body 69 is pressed downward by a spring 68 which is attached to a supporting body 67. In this first valve mechanism 63, when inside the cylinder 23 is pressurized, as shown in FIG. 11, the opening 41 is blocked by the valve body 71 closely contacting the lower-end inner circumference of the cylinder 23. When inside the cylinder 23 is decompressed, as shown in FIG. 12, the opening 41 is unblocked by the valve body 71 separating from the lower-end inner circumference of the cylinder 23 against the momentum given by the coil spring 72.

The second valve mechanism 61 comprising an outlet valve mechanism that possesses the spherical valve body 65 and the coil spring 66 supported by the supporting body 67 for increasing momentum of the spherical valve body 65 toward the upper end of the coupling tube 21, which functions as a valve seat for this valve body. In this second valve mechanism 61, when the nozzle head 2 is pressed down, as shown in FIG. 11, the opening 44 is unblocked by the valve body 65 separating from the upper-end inner circumference of the coupling tube 21. When the pressure applied to the nozzle head 2 is released, as shown in FIG. 12, the opening 44 is blocked by the valve body 65 closely contacting the upper-end inner circumference of the coupling tube 21 with the momentum given by the coil spring 66.

Different from the coil spring 24, the coil springs 66, 68, and 72 directly contact the liquid. For this reason, coil springs 66 and 72 are made of resin or any suitable plastic. In this case, the coil springs 66 and 72 only require to possess sufficient strength for increasing the momentum of the valve bodies 65 and 71, and large momentum similar to the coil spring 24 is not required. Consequently, a resin coil spring can be used without any problem.

The liquid dispensing operation of the liquid container possessing the above-mentioned liquid dispensing pump 1 according to the third embodiment is described in FIGS. 10 through 12.

In an initial position, as shown in FIG. 10, the valve body 65 forcibly contacts the upper-end inner circumference of the coupling tube 21 by the action of the coil spring 66, blocking the opening 44. Similarly, by the action of the coil spring 24, the coupling tube 21 is in an ascending position relatively to the piston 22, the O-ring 48 closely contacts a valve seat formed at the lower end of the piston 22, blocking the opening 47. A valve body 71 contacts the lower-end inner circumference of the cylinder 23 by the action of the coil spring 72.

When the pressing portion 12 in the nozzle head 2 is pressed down, as shown in FIG. 11, the nozzle head 2 descends relatively to the coupling tube 21. As a result, a protruding portion 64 attached inside the nozzle head 2 is pressed down, causing the valve body 65 to separate from the upper-end inner circumference of the coupling tube 21 against the momentum of the coil spring 66, unblocking the opening 44.

When the pressing portion 12 in the nozzle head 2 is further pressed down, the upper end of the coupling tube 21 and the nozzle head 2 closely contact and descend as one. Due to this, the coupling tube 21 descends relatively to the piston 22, and the O-ring 48 separates from a valve seat formed at the lower end of the piston 22, unblocking the opening 47.

When the pressing portion 12 in the nozzle head 2 is further pressed down, the nozzle head 2 and the coupling tube 21 descend as one with the upper end of the piston 22 closely contacting the O-ring 33 provided at the periphery of the coupling tube 21. At this time, inside the cylinder 23 is pressurized and the valve body 71 closely contacts the lower-end inner circumference of the cylinder 23, blocking the opening 41. Consequently, a pressurized liquid inside the cylinder 23 flows out to the discharge portion 11 in the nozzle head 2 via the coupling tube 21 and the opening 44 and is dispensed from the discharge portion 11.

As shown in FIG. 12, if pressure applied to the nozzle head 2 is released after the piston 22 descends to the lower end of a stroke, the nozzle head 2 ascends relatively to the coupling tube 21 by the action of the coil spring 24 and the coupling tube 21 ascends relatively to the piston 22. As a result, in the second valve mechanism 61 the valve body 65 closely contacts the upper-end inner circumference of the coupling tube 21, blocking the opening 44. In the third valve mechanism 27, the O-ring 48 closely contacts a valve seat formed at the lower end of the piston 22, blocking the opening 47.

After that, by the action of the coil spring 24, the nozzle head 2, the coupling tube 21 and the piston 22 ascend as one. At this time, because inside the cylinder 23 is decompressed, the valve body 71 separates from the lower-end inner circumference of the cylinder 23 against the momentum from the coil spring 72, the opening 41 is unblocked, and the liquid flows into the cylinder 23 from the liquid-storing unit 4. As shown in FIG. 12, when the piston 22 moves to the upper end of its elevating stroke, it stops its ascending motion.

By repeating the above-mentioned operation, dispensing the liquid stored in the liquid-storing unit 4 from the nozzle head 2 becomes possible.

According to the present invention because contact of a liquid and a coil spring that raises a piston can be avoided, coil spring corrosion and metal elution can be effectively prevented. Additionally, when discarding the liquid dispensing pump, the metal coil spring can be easily dismantled.

As explained above, according to an embodiment of the present invention, leaking of a liquid can be prevented by securely blocking each opening.

Further, according to an embodiment of the present invention, an amount of a liquid remaining inside the liquid dispensing pump after the liquid passes through the second valve mechanism can be minimized. That is, the pump can be downsized effectively.

According to an embodiment of the present invention, because the second valve mechanism blocks the opening formed near the upper end of the coupling tube, said opening being the passage between inside the coupling tube and the nozzle head, by utilizing momentum of the coil spring, the opening can be securely blocked even when high-viscosity liquids, semi-liquids, gels or creams produced when sol solidifies into jellylike form and others, are used as a liquid.

Additionally according to an embodiment of the present invention, by the action of the first valve mechanism and the third valve mechanism, even when pressure is applied to a liquid stored in a liquid-storing unit, leaking of the liquid can be effectively prevented.

The liquid dispensing pump of the present invention may be applied to a highly airtight liquid container possessing a hard cylinder component and a piston component, which moves inside the cylinder component in the direction of the nozzle head as the amount of the liquid decreases.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A liquid dispensing pump adapted to be connected to a container, comprising:

a nozzle head having a nozzle from which a liquid stored in the container is dispensed;

an inner tube connected to the nozzle, said tube having (i) a closed end on a side opposite to the nozzle, (ii) a first outward projection at the closed end, (iii) a second outward projection apart from the closed end, and (iv) an opening between the first and second outward projections;

a cylinder into which the closed end of the tube is inserted;

a piston provided inside the cylinder and movable between the first and second outward projections, said piston comprising two annular packing members, each separately contacting an inner wall of the cylinder and being liquid-tightly slidable along an inner wall of the cylinder, wherein (a) when the nozzle head is not pressed downward, the first outward projection liquid-tightly contacts the piston, and (b) when the nozzle head is pressed downward, the first outward projection is detached from the piston to communicate the tube and the cylinder between the first outward projection and the piston through the opening of the tube, whereas the second outward projection pushes the piston downward;

a pushing member which constantly pushes the nozzle head upward; and a one-way valve provided at an end of the cylinder opposite to the nozzle head, said valve opening only in a direction to bring a liquid stored in the container into the cylinder;

wherein (I) the liquid in the container moves into the cylinder though the valve when the nozzle head moves upward by the pushing member, and (II) the liquid brought in the cylinder moves between the first outward projection and the piston into the tube through the opening of the tube toward the nozzle when the nozzle head is pressed downward.

2. The liquid dispensing pump as claimed in claim 1, wherein the pushing member is a spring provided along a periphery of the tube between the nozzle head and the cylinder.

3. A container with a liquid dispensing pump, comprising:

the liquid dispensing pump of claim 1; and a container attached to the liquid dispensing pump.

4. The container as claimed in claim 3, wherein the container is cylindrical.

5. The container as claimed in claim 4, wherein the container has a movable bottom which is liquid-tightly slidable upward along an inner wall of the container according to the pressure in the container, wherein as a liquid is stored in the container and the liquid is dispensed through the nozzle, the movable bottom moves upward.

6. The container as claimed in claim 5, wherein the movable bottom is formed in a shape corresponding to the shape of the end of the cylinder of the liquid dispensing pump.

7. The container as claimed in claim 3, wherein the liquid dispensing pump is liquid-tightly attached to a top of the container.

8. The liquid dispensing pump as claimed in claim 1, wherein the end of the cylinder is tapered, and the valve has a tapered surface to liquid-tightly contact the tapered end of the cylinder when the nozzle head is pressed downward.

9. The liquid dispensing pump as claimed in claim 8, wherein the valve further comprises a stopper at its lower end, said stopper being provided under a cylinder opening which is closed by the tapered surface of the valve and having a diameter greater than that of the cylinder opening.

10. The liquid dispensing pump as claimed in claim 1, wherein no urging member is provided inside the cylinder.

11. The liquid dispensing pump as claimed in claim 1, wherein the annular packing members are made of silicon rubber.

12. The liquid dispensing pump as claimed in claim 1, wherein the annular packing members have an upside-down V-shaped cross-section.

13. A liquid dispensing pump adapted to be connected to a container, comprising:

a nozzle head having a nozzle from which a liquid stored in the container is dispensed;

an inner tube connected to the nozzle, said tube having (i) a closed end on a side opposite to the nozzle, (ii) a first outward projection at the closed end, (iii) a second outward projection apart from the closed end, and (iv) an opening between the first and second outward projections;

a cylinder into which the closed end of the tube is inserted;

a piston provided inside the cylinder and movable between the first and second outward projections, said piston being liquid-tightly slidable along an inner wall of the cylinder, wherein (a) when the nozzle head is not pressed downward, the first outward projection liquid-tightly contacts the piston, and (b) when the nozzle head is pressed downward, the first outward projection is detached from the piston to communicate the tube and the cylinder between the first outward projection and the piston through the opening of the tube, whereas the second outward projection pushes the piston downward;

a pushing member which constantly pushes the nozzle head upward; and a one-way valve closing a cylinder opening provided at an end of the cylinder opposite to the nozzle head, said valve opening only in a direction to bring a liquid stored in the container into the cylinder through the cylinder opening;

wherein (I) the liquid in the container moves into the cylinder though the valve when the nozzle head moves upward by the pushing member, and (II) the liquid brought in the cylinder moves between the first outward projection and the piston into the tube through the opening of the tube toward the nozzle when the nozzle head is pressed downward, wherein the end of the cylinder is tapered, and the valve has a tapered surface to liquid-tightly contact the tapered end of the cylinder when the nozzle head is pressed downward, said valve further comprising a stopper at its lower end, said stopper being provided under the cylinder opening and having a diameter greater than that of the cylinder opening.

14. The liquid dispensing pump as claimed in claim 13, wherein the end of the cylinder is tapered, and the valve includes an O-ring to liquid-tightly contact the tapered end of the cylinder when the nozzle head is pressed downward.

15. The liquid dispensing pump as claimed in claim 13, wherein the end of the cylinder has an opening, and the valve includes a ball and a spring pressing the ball downward to liquid-tightly close the opening when the nozzle head is pressed downward, said spring being attached to the closed end of the tube.

16. The liquid dispensing pump as claimed in claim 13, wherein the first outward projection is an O-ring which liquid-tightly contacts the piston when the nozzle head is not pressed.

17. The liquid dispensing pump as claimed in claim 13, wherein the second outward projection is an O-ring which liquid-tightly contacts the piston when the nozzle head is pressed.

18. The liquid dispensing pump as claimed in claim 13, further comprising an upper valve provided at a connection between the nozzle head and the tube, wherein said upper valve opens when the nozzle head is pressed.

19. The liquid dispensing pump as claimed in claim 18, wherein the upper valve includes an O-ring to liquid-tightly close the connection between the nozzle head and the tube when the nozzle head is not pressed downward.

20. The liquid dispensing pump as claimed in claim 18, wherein the upper valve includes a ball and a spring pressing the ball upward to liquid-tightly close the connection between the nozzle head and the tube when the nozzle is not pressed downward.

21. The liquid dispensing pump as claimed in claim 13, wherein the pushing member is a spring provided along a periphery of the tube between the nozzle head and the cylinder.

22. A liquid dispensing pump for dispensing a liquid stored and accumulated inside a liquid-storing unit from a nozzle head by pressing down said nozzle head provided over the liquid-storing unit comprising:

a cylinder provided on top of said liquid-storing unit, a piston that can move reciprocally inside said cylinder, said piston comprising two annular packing members, each separately contacting an inner wall of the cylinder, a coupling tube for lowering said piston by transmitting pressure applied to said nozzle head by connecting said nozzle head with said piston, a coil spring provided at the peripheral portion of said coupling tubes for increasing momentum of said piston via said coupling tubes in its ascending direction, an inlet valve mechanism for bringing a liquid stored in said liquid-storing unit into said cylinder with the ascending motion of said piston, and an outlet valve mechanism for moving the liquid brought into said cylinder with the descending motion of said piston out to said nozzle head via an inside of said coupling tube.

23. The liquid dispensing pump as claimed in claim 22, wherein said inlet valve mechanism is provided near a lower end of said cylinder, wherein said inlet valve mechanism blocks an opening formed near the lower end of said cylinder, said opening being a passage between said liquid-storing unit and said cylinder, when the inside of said cylinder is pressurized, and unblocks said opening when the inside of said cylinder is decompressed.

24. The liquid dispensing pump as claimed in claim 23, wherein an internal surface of the lower end of said cylinder is formed in a tapered shape, and said inlet valve mechanism has a tapered valve body so that its external surface can closely contact the internal surface of the lower end of said cylinder.

25. The liquid dispensing pump as claimed in claim 23, wherein said inlet valve mechanism has a supporting component which can move up and down and an O-ring provided at the periphery of said supporting component.

26. The liquid dispensing pump as claimed in claim 23, wherein said inlet valve mechanism further comprises a stopper at its lower end, said stopper being provided under said opening and having a diameter greater than that of said opening.

27. The liquid dispensing pump as claimed in claim 22, wherein said outlet valve mechanism opens an opening, said opening being a passage between an inside of said coupling tube and an inside of said cylinder, by separating from said piston when said nozzle head is pressed down, and blocks said opening by closely contacting said piston when the pressure applied to said nozzle head is released.

28. The liquid dispensing pump as claimed in claim 27, wherein said packing members are made of resin.

29. The liquid dispensing pump as claimed in claim 22, wherein said outlet valve mechanism is provided near a lower end of said coupling tube, wherein said outlet valve mechanism unblocks an opening formed near the lower end of said coupling tube, said opening being a passage between an inside of said cylinder and an inside of said coupling tube when said nozzle head is pressed down, and blocks said opening when the pressure applied to said nozzle head is released.

30. The liquid dispensing pump as claimed in claim 22, wherein said outlet valve mechanism is provided near the upper end of said coupling tube, wherein said outlet valve mechanism, unblocks an opening formed near the upper end of said coupling tube, said opening being a passage between an inside of said coupling tube and an inside of said nozzle head, when said nozzle head is pressed down, and blocks said opening when the pressure applied to said nozzle head is released.

31. The liquid dispensing pump as claimed in claim 30, wherein by being pressed down by said nozzle head from its upper position, said outlet valve mechanism unblocks the opening formed near the upper end of said coupling tube.

32. The liquid dispensing pump as claimed in claim 31, wherein said outlet valve mechanism is provided inside said nozzle head.

33. The liquid dispensing pump as claimed in claim 30, wherein said outlet valve mechanism has a supporting component which can move up and down and an O-ring provided at the periphery of said supporting component.

34. The liquid dispensing pump as claimed in claim 30, wherein by using the momentum of a coil spring, said outlet valve mechanism blocks the opening formed near the upper end of said coupling tube.

35. The liquid dispensing pump as claimed in claim 30, wherein a second outlet valve mechanism is provided near the lower end of said coupling tube, wherein said second outlet valve mechanism unblocks an opening formed near the lower end of said coupling tube, said opening being a passage between an inside of said cylinder and an inside of said coupling tube when said nozzle head is pressed down, and blocks said opening when the pressure applied to said nozzle head is released.

36. The liquid dispensing pump as claimed in claim 22, wherein said liquid-storing unit comprises a hard cylinder component and a piston component which moves inside said cylinder component in the direction of said nozzle head as the amount of the liquid decreases.

37. The liquid dispensing pump as claimed in claim 22, wherein the spring is provided along a periphery of the tube between the nozzle head and the cylinder.

38. The liquid dispensing pump as claimed in claim 22, wherein no urging member provided inside the cylinder.

39. The liquid dispensing pump as claimed in claim 22, wherein the annular packing members are made of silicon rubber.

40. The liquid dispensing pump as claimed in claim 22, wherein the annular packing members have an upside-down V-shaped cross-section.

41. A liquid dispensing pump for dispensing a liquid stored and accumulated inside a liquid-storing unit from a nozzle head by pressing down said nozzle head provided over the liquid-storing unit comprising:

a cylinder provided on top of said liquid-storing unit, a piston that can move reciprocally inside said cylinder, a coupling tube for lowering said piston by transmitting pressure applied to said nozzle head by connecting said nozzle head with said piston, a coil spring provided at the peripheral portion of said coupling tube for increasing momentum of said piston via said coupling tube in its ascending direction, an inlet valve mechanism for bringing a liquid stored in said liquid-storing unit into said cylinder with the ascending motion of said piston, said inlet valve mechanism being provided near a lower end of said cylinder, wherein said inlet valve mechanism blocks an opening formed near the lower end of said cylinder, said opening being a passage between said liquid-storing unit and said cylinder, when the inside of said cylinder is pressurized, and unblocks said opening when the inside of said cylinder is decompressed, wherein an internal surface of the lower end of said cylinder is formed in a tapered shape, and said inlet valve mechanism has a tapered valve body so that its external surface can closely contact the internal surface of the lower end of said cylinder, said inlet valve mechanism further comprising a stopper at its lower end, said stopper being provided under said opening and having a diameter greater than that of said opening, and an outlet valve mechanism for moving the liquid brought into said cylinder with the descending motion of said piston out to said nozzle head via an inside of said coupling tube.

* * * * *